US009324265B2

(12) United States Patent
Han

(10) Patent No.: US 9,324,265 B2
(45) Date of Patent: Apr. 26, 2016

(54) PIXEL, DISPLAY DEVICE INCLUDING THE SAME, AND DRIVING METHOD THEREOF

(71) Applicant: SAMSUNG DISPLAY CO., LTD., Yongin, Gyeonggi-do (KR)

(72) Inventor: Sang-Myeon Han, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 215 days.

(21) Appl. No.: 13/765,672

(22) Filed: Feb. 12, 2013

(65) Prior Publication Data

US 2014/0118229 A1 May 1, 2014

(30) Foreign Application Priority Data

Oct. 26, 2012 (KR) ..... 10-2012-0119734

(51) Int. Cl.
*G09G 3/32* (2006.01)

(52) U.S. Cl.
CPC ..... *G09G 3/3233* (2013.01); *G09G 2300/0852* (2013.01); *G09G 2300/0861* (2013.01)

(58) Field of Classification Search
CPC ..... G09G 3/325; G09G 2300/0861; G09G 2320/045; G09G 2320/0233; G09G 2310/0251; G09G 3/30; G09G 3/3208; G09G 3/3216; G09G 3/3225; G09G 3/3233; G09G 3/32; G09G 2300/0852
USPC ..... 345/960, 211, 82
See application file for complete search history.

(56) References Cited

U.S. PATENT DOCUMENTS

| | | | | |
|---|---|---|---|---|
| 8,723,763 | B2 * | 5/2014 | Jeong | G09G 3/3233 345/82 |
| 2011/0025671 | A1 * | 2/2011 | Lee | G09G 3/003 345/211 |
| 2012/0026146 | A1 * | 2/2012 | Kim | G09G 3/3233 345/211 |
| 2012/0139961 | A1 * | 6/2012 | Choi | H05B 33/0896 345/690 |
| 2013/0300724 | A1 * | 11/2013 | Chaji | G09G 3/3233 345/212 |
| 2014/0139502 | A1 * | 5/2014 | Han | G09G 3/3233 345/212 |

FOREIGN PATENT DOCUMENTS

| | | |
|---|---|---|
| KR | 10-2011-0013692 | 2/2011 |
| KR | 10-2011-0013693 | 2/2011 |
| KR | 10-2012-0062499 | 6/2012 |

* cited by examiner

*Primary Examiner* — Aneeta Yodichkas
*Assistant Examiner* — Chineyere Wills-Burns
(74) *Attorney, Agent, or Firm* — Lewis Roca Rothgerber Christie LLP

(57) ABSTRACT

A plurality of pixels each including a first capacitor coupled between a data line and a first node, a switching transistor for electrically connecting the first node and a second node, a second capacitor coupled between the second node and a third node, an initialization transistor for transmitting a first power source voltage to the second node, and a driving transistor including a gate electrode coupled to the third node to control a driving current to an organic light emitting diode, in which light emission of the organic light emitting diode by the driving current is concurrently performed in the plurality of pixels according to data signals transmitted during a previous frame.

24 Claims, 5 Drawing Sheets

PIXEL, DISPLAY DEVICE INCLUDING THE SAME, AND DRIVING METHOD THEREOF

CROSS-REFERENCE TO RELATED APPLICATION

This application claims priority to and the benefit of Korean Patent Application No. 10-2012-0119734 filed in the Korean Intellectual Property Office on Oct. 26, 2012, the entire contents of which are incorporated herein by reference.

BACKGROUND (a) Field

Aspects of the present invention relate to a display device and a driving method thereof.

(b) Description of the Related Art

An organic light emitting diode display uses an organic light emitting diode (OLED) in which luminance is controlled by current or a voltage. The organic light emitting diode includes an anode layer and a cathode layer forming an electric field, and an organic light emitting material for emitting light by the electric field.

The organic light emitting diode (OLED) display may be classified as a passive matrix OLED (PMOLED) or an active matrix OLED (AMOLED) according to a method of driving the organic light emitting diode.

The active matrix OLED display device has good resolution, contrast, and an operation speed. One frame of the active matrix OLED display device may include a scan period for storing image data and a light emitting period for emitting light according to the recorded image data.

As the display panel becomes large and the resolution increases, a time for recording image data increases and driving of the display device becomes difficult.

When the display device displays a three-dimensional image, the aforementioned phenomenon begins to accumulate. When the display device displays a three-dimensional device according to a national television system committee (NTSC) method, the display device alternately displays 60 frames of a left-eye image and 60 frames of a right-eye image per one second. Accordingly, a driving frequency of the display device displaying a three-dimensional image is at least two times the driving frequency of a display device displaying a standard image.

A pixel having a structure appropriate for a large display panel and the display of a high resolution and three-dimensional image and capable of sufficiently securing an aperture ratio is demanded.

The above information disclosed in this Background section is only for enhancement of understanding of the background of the present disclosure, and therefore, it may contain information that does not form the prior art that is already known in this country to a person of ordinary skill in the art.

SUMMARY

Embodiments of the present invention provide a pixel for a large display panel for displaying of a high resolution and 3D image, and having a suitable aperture ratio, and a display device including the pixel, and a method of driving the display device.

An exemplary embodiment of the present invention provides a display device including a plurality of pixels, each of the plurality of pixels including: a first capacitor coupled between a data line and a first node; a switching transistor configured to electrically connect the first node and a second node; a second capacitor coupled between the second node and a third node; an initialization transistor for transmitting a first power source voltage to the second node; and a driving transistor including a gate electrode coupled to the third node and configured to control a driving current flowing from the first power source voltage to an organic light emitting diode. Here, light emission of the organic light emitting diode by the driving current is configured to be concurrently performed in the plurality of pixels, an initialization signal having a gate ON voltage is configured to be transmitted so that the initialization transistor is turned on, and a scan signal having the gate ON voltage and corresponding to each of the plurality of pixels is configured to be transmitted to the switching transistor so that a data voltage corresponding to the first capacitor is stored.

Each of the plurality of pixels may further include a compensation transistor for electrically connecting the gate electrode and an other electrode of the driving transistor together.

The initialization transistor may be configured to be turned on and the first power source voltage may be configured to be changed to a low level voltage so that a voltage of the third node is decreased through coupling by the second capacitor, and so that current flows from an anode electrode of the organic light emitting diode to the first power source voltage through the driving transistor to decrease an anode voltage of the organic light emitting diode.

After the anode voltage of the organic light emitting diode is decreased, a second power source voltage applied to a cathode electrode of the organic light emitting diode may be configured to be changed to the low level voltage so that the anode voltage of the organic light emitting diode is further decreased through coupling by a parasitic capacitor of the organic light emitting diode.

After the second power source voltage is changed to the low level voltage, a compensation control signal having the gate ON voltage may be configured to be applied to the compensation transistor so that the compensation transistor is turned on and the anode voltage of the organic light emitting diode is reset.

After the anode voltage of the organic light emitting diode is reset, the second power source voltage may be configured to be changed to a high level voltage.

After the second power source voltage is changed to the high level voltage, the first power source voltage may be configured to be changed to the high level voltage in a state where the initialization transistor is turned on and the compensation transistor is turned on to diode-connect the driving transistor.

After the driving transistor is diode-connected, the initialization transistor may be configured to be turned off, the switching transistor may be configured to be turned on, and a reference voltage may be configured to be applied to the data line so that a voltage of the second node is changed by the data voltage stored in the first capacitor, and so that a voltage corresponding to the data voltage is stored in the second capacitor.

The data voltage stored in the first capacitor in a current frame may be configured to be a data voltage applied in a previous frame, and a voltage corresponding to the data voltage applied in the previous frame may be configured to be stored in the second capacitor.

After the voltage corresponding to the data voltage is stored in the second capacitor, the switching transistor and the compensation transistor may be configured to be turned off and the initialization transistor may be configured to be turned on so that the voltage of the third node is changed.

After the voltage of the third node is changed, the first power source voltage may be configured to be maintained at the high level voltage, and the second power source voltage may be configured to be changed to the low level voltage so that the organic light emitting diode emits light according to the driving current flowing to the organic light emitting diode through the driving transistor.

After the organic light emitting diode emits light, the second power source voltage may be configured to be changed to the high level voltage, and the compensation transistor may be configured to be turned on so that the voltage of the gate electrode and the other electrode of the driving transistor are reset to a specific voltage.

According to an embodiment of the present invention, there is provided a method of driving a display device including a plurality of pixels, each of the plurality of pixels including: a first capacitor coupled between a data line and a first node, a switching transistor configured to electrically connect the first node and a second node, a second capacitor coupled between the second node and a third node, an initialization transistor for transmitting a first power source voltage to the second node, and a driving transistor including a gate electrode coupled to the third node to control a driving current to flow from the first power source voltage to an organic light emitting diode, the method including: a scanning operation in which an initialization signal having a gate ON voltage is applied to a gate electrode of the initialization transistor and a scan signal having the gate ON voltage is applied to the gate electrode of the switching transistor so that a data voltage is stored in the first capacitor; and a light emitting operation in which the organic light emitting diode emits light according to the driving current flowing through the driving transistor according to a voltage stored in the second capacitor. Here, the light emitting operation of each of the plurality of pixels is concurrently performed, and the scanning operation and the light emitting operation at least partially overlap each other.

The method may further include: an initialization operation in which the first power source voltage and a second power source voltage transmitted to a cathode electrode of the organic light emitting diode are at a low level voltage, and a compensation transistor for electrically connecting the gate electrode and an other electrode of the driving transistor together is turned on so that an anode voltage of the organic light emitting diode is reset.

The initialization operation may include: turning on the initialization transistor and changing the first power source voltage to the low level voltage to decrease a voltage of the third node through coupling by the second capacitor; and making current flow to the first power source voltage from an anode electrode of the organic light emitting diode through the driving transistor to decrease the anode voltage of the organic light emitting diode.

The initialization operation may further include: changing the second power source voltage applied to the cathode electrode of the organic light emitting diode to the low level voltage after the anode voltage of the organic light emitting diode is decreased to further decrease the anode voltage of the organic light emitting diode through coupling by a parasitic capacitor of the organic light emitting diode.

The initialization operation may further include: changing the second power source voltage to a high level voltage after the anode voltage of the organic light emitting diode is reset.

The method may further include a compensation operation in which, after the second power source voltage is changed to the high level voltage, the first power source voltage is changed to the high level voltage in a state where the initialization transistor is turned on and the compensation transistor is turned on to diode-connect the driving transistor.

The compensation operation may include: turning off the initialization transistor after the driving transistor is diode-connected; applying a reference voltage to the data line and turning on the switching transistor; and changing the voltage of the second node according to a data voltage stored in the first capacitor, and storing a voltage corresponding to the data voltage in the second capacitor.

The data voltage stored in the first capacitor in a current frame may be a data voltage applied in a previous frame, and the storing of the voltage corresponding to the data voltage in the second capacitor may include storing a voltage corresponding to the data voltage applied in the previous frame in the second capacitor.

The compensation operation may further include: turning off the switching transistor and the compensation transistor after the voltage corresponding to the data voltage is stored in the second capacitor; and turning on the initialization transistor to change the voltage of the third node.

The light emitting operation may include: maintaining the first power source voltage at the high level voltage and changing the second power source voltage to the low level voltage after the voltage of the third node is changed; and making the organic light emitting diode emit light by making the driving current flow to the organic light emitting diode through the driving transistor.

The method may further include: a bias operation in which the second power source voltage is changed to the high level voltage after the organic light emitting diode emits light, and the compensation transistor is turned on so that the voltage of the gate electrode and the other electrode of the driving transistor are reset to a specific voltage.

According to an embodiment of the present invention there is provided a pixel, including: a first capacitor including one electrode coupled to a data line and an other electrode coupled to a first node; a switching transistor including a gate electrode for receiving a scan signal, one electrode coupled to the first node, and an other electrode coupled to a second node; a second capacitor including one electrode coupled to the second node and an other electrode coupled to a third node; a driving transistor including a gate electrode coupled to the third node, one electrode coupled to a first power source for supplying a first power source voltage, and an other electrode coupled to an anode electrode of an organic light emitting diode; and an initialization transistor including a gate electrode for receiving an initialization signal, one electrode coupled to the first power source voltage, and an other electrode coupled to the second node.

The pixel may further include: a compensation transistor including a gate electrode for receiving a compensation control signal, one electrode coupled to the third node, and an other electrode coupled to the anode electrode of the organic light emitting diode.

Pixels according to embodiments of the present invention are appropriate for a large display panel, are capable of displaying a high resolution and three-dimensional image, and achieve a suitable aperture ratio.

BRIEF DESCRIPTION OF THE DRAWINGS

The accompanying drawings, together with the specification, illustrate exemplary embodiments of the present invention that serve to explain aspects and features of the present invention.

DETAILED DESCRIPTION

Figure 1:
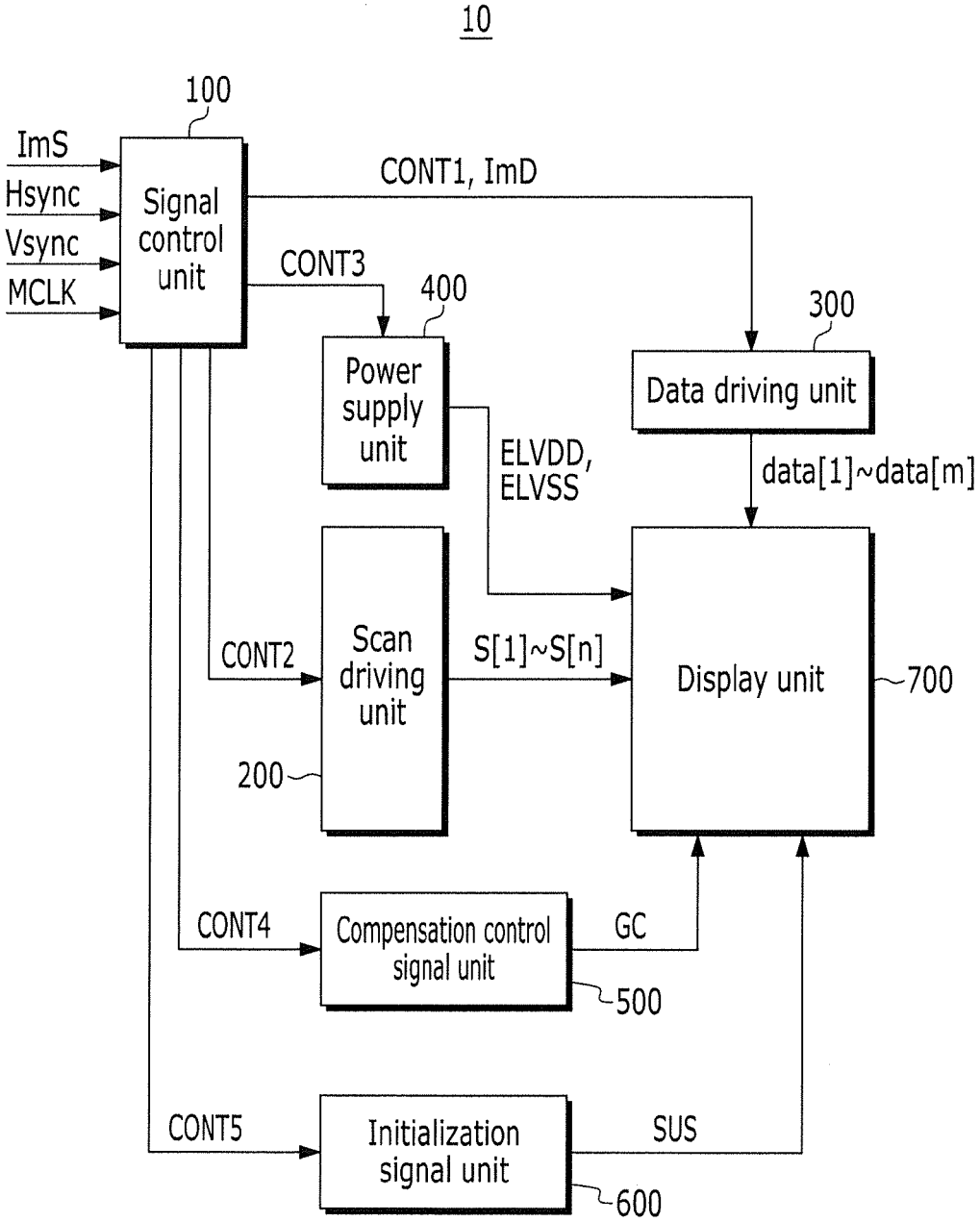
FIG. 1 is a block diagram illustrating a display device according to an exemplary embodiment of the present invention.

Hereinafter, exemplary embodiments according to the present invention will be described in detail with reference to accompanying drawings so as to be easily understood by a person of ordinary skill in the art. However, the present invention may be variously implemented or modified and is not limited to the following embodiments.

Further, in the description of some exemplary embodiments, an element having the same (or a substantially similar) configuration may be representatively described by reference to a first exemplary embodiment by using the same reference numeral, and other configurations different from those of the first exemplary embodiment may be described in other exemplary embodiments.

An element not necessary to the understanding of features of the present invention may be omitted to clearly describe the features of present invention.

Throughout this specification and the claims that follow, when it is described that an element is "coupled" (e.g., electrically coupled or connected) to another element, the element may be directly coupled to the other element or indirectly coupled to the other element through a one or more intervening element. In addition, unless explicitly described to the contrary, the word "comprise" and variations such as "comprises" or "comprising" should be understood to imply the inclusion of stated elements but not the exclusion of any other elements.

FIG. 1 is a block diagram illustrating a display device according to an exemplary embodiment of the present invention.

Referring to FIG. 1, the display device 10 includes a signal control unit 100, a scan driving unit 200, a data driving unit 300, a power supply unit 400, a compensation control signal unit 500, an initialization signal unit 600, and a display unit 700.

The signal control unit 100 may receive an image signal ImS and a synchronization signal input from an external device. The input image signal ImS contains information on luminance of a plurality of pixels. The luminance has a suitable (e.g., a predetermined) number of grays (or gray levels), for example, $1024=2^{10}$, $256=2^{8}$, or $64=2^{6}$. The synchronization signal may include a horizontal synchronization signal Hsync, a vertical synchronization signal Vsync, and a main clock signal MCLK.

The signal control unit 100 according to an embodiment of the present invention generates first to fifth driving control signals CONT1, CONT2, CONT3, CONT4, and CONT5, and an image data signal ImD according to the image signal ImS, the horizontal synchronization signal Hsync, the vertical synchronization signal Vsync, and the main clock signal MCLK.

The signal control unit 100 may divide the image signal ImS according to the vertical synchronization signal Vsync in the unit of a frame, and may divide the image signal ImS according to the horizontal synchronization signal Hsync in the unit of a scan line to generate an image data signal ImD. The signal control unit 100 may transmit the image data signal ImD to the data driving unit 300 together with the first driving control signal CONT1.

The display unit 700 is a display area including a plurality of pixels. The display unit 700 is formed so that a plurality of scan lines extending in an approximate row direction to be parallel (or almost parallel) to each other, a plurality of data lines extending in an approximate column direction to be parallel (or almost parallel) to each other, a plurality of power lines, a plurality of compensation control lines, and a plurality of initialization lines are coupled to the plurality of pixels. The plurality of pixels is arranged in a matrix shape (or an approximate matrix shape).

The scan driver 200 is coupled to the plurality of scan lines, and generates a plurality of scan signals S[1]-S[n] according to a second driving control signal CONT2. The scan driver 200 may sequentially apply the scan signals S[1]-S[n] of a gate ON voltage to the plurality of scan lines.

The data driver 300 is coupled to the plurality of data lines, samples and holds the image data signal ImD input according to the first driving control signal CONT1, and transmits a plurality of data signals data[1]-data[m] to the plurality of data lines. The data driver 300 may apply the data signal having a suitable (e.g., set or predetermined) voltage range to the plurality of data lines in response to the scan signals S[1]-S[n] of the gate ON voltage.

The power supply unit 400 is coupled to the plurality of power lines, and may adjust voltage levels of a first power source voltage ELVDD and a second power source voltage ELVSS according to a third driving control signal CONT3.

The compensation control signal unit 500 is coupled to the plurality of compensation control lines, and may generate a compensation control signal GC according to a fourth driving control signal CONT4.

The initialization signal unit 600 is coupled to the plurality of initialization lines, and may generate an initialization signal SUS according to a fifth driving control signal CONT5.

Figure 2:
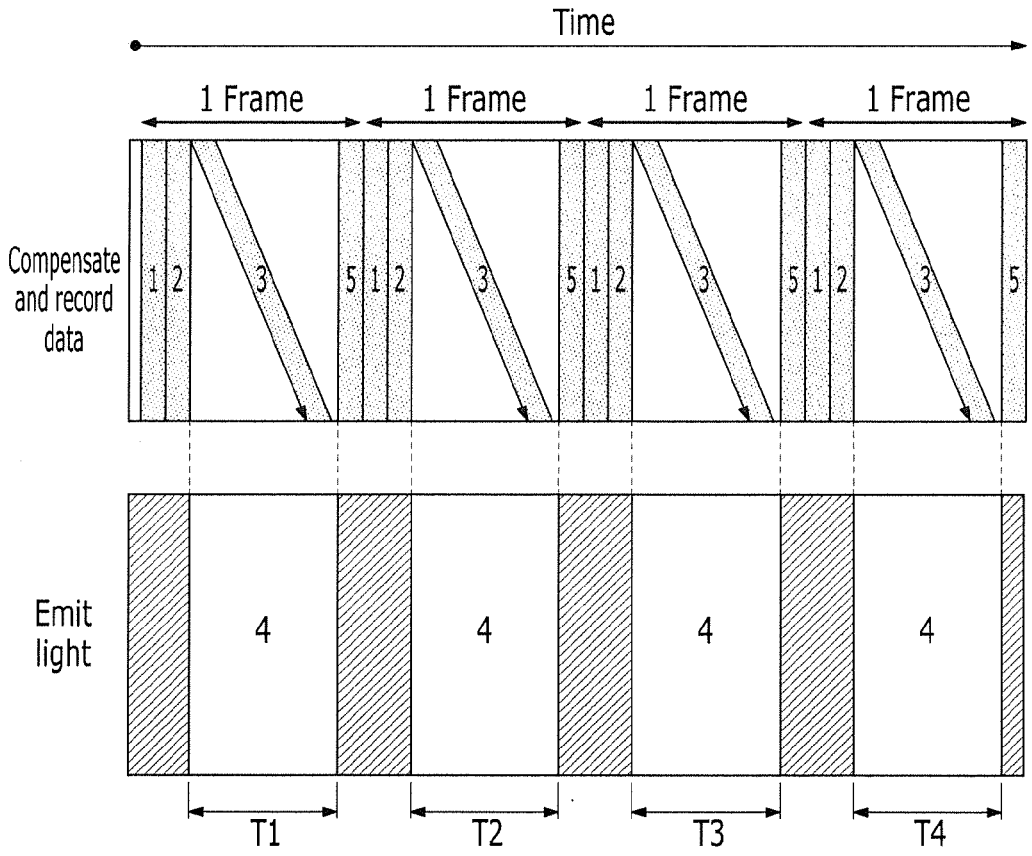
FIG. 2 is a diagram illustrating a method of driving a display device according to an exemplary embodiment of the present invention.

FIG. 2 is a diagram illustrating a method of driving a display device according to an exemplary embodiment of the present invention.

Referring to FIG. 2, one frame for which one image is displayed on the display unit 700 includes an initialization period (or term) 1 for initializing a driving voltage of an organic light emitting diode of the pixel, a compensation period (or term) 2 for compensating a threshold voltage of a driving transistor of the pixel, a scan period (or term) 3 for recording data in each of the plurality of pixels, a light emitting period (or term) 4 for emitting light in response to the data in which the plurality of pixels is recorded, and a bias period (or term) 5 for improving response waveforms of the plurality of pixels. The bias period 5 may be omitted according to the method of driving the display device.

The scan period 3 and the light emitting period 4 are generated while overlapping in time. The pixels emit light at the light emitting period 4 of a current frame according to the data recorded at the scan period 3 of a previous frame. The pixels emit light at the light emitting period 4 of a next frame according to the data recorded in the pixel at the scan period 3 of the current frame.

For example, term T1 includes the scan period 3 and the light emitting period 4 of an $N^{th}$ frame. Data recorded in the pixels at the scan period 3 of term T1 is data of the $N^{th}$ frame, and the pixels emit light at the light emitting period 4 of term T1 according to data of an N−1$^{th}$ frame recorded at the scan period 3 of the N−1$^{th}$ frame.

Term T2 includes the scan period 3 and the light emitting period 4 of an With frame. Data recorded in the pixels at the scan period 3 of term T2 is data of the N+1$^{th}$ frame, and the pixels emit light at the light emitting period 4 of term T2 according to the data of the N$^{th}$ frame recorded at the scan period 3 of the N$^{th}$ frame, that is the term T1.

Term T3 includes the scan period 3 and the light emitting period 4 of an N+2$^{th}$ frame. Data recorded in the pixels at the scan period 3 of term T3 is data of the N+2$^{th}$ frame, and the pixels emit light at the light emitting period 4 of term T3 according to the data of the N+1$^{th}$ frame recorded at the scan period 3 of the N+1$^{th}$ frame, that is the term T2.

Term T4 includes the scan period 3 and the light emitting period 4 of an N+3$^{th}$ frame. Data recorded in the pixels at the scan period 3 of term T4 is data of the N+3$^{th}$ frame, and the pixels emit light at the light emitting period 4 of term T4 according to the data of the N+2$^{th}$ frame recorded at the scan period 3 of the N+2$^{th}$ frame, that is the term T3.

A pixel structure in which data of the current frame is recorded at the scan period 3, and the pixels emit light according to the data of the previous frame at the light emitting period 4 that is a period overlapping the scan period 3 will be described with reference to FIG. 3.

Figure 3:
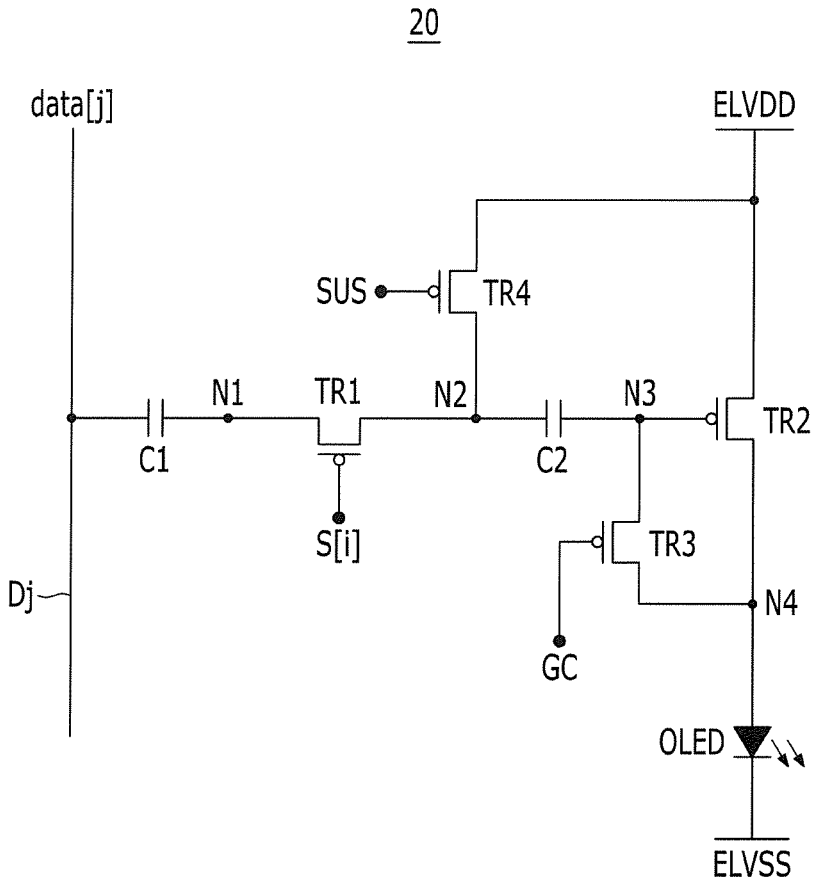
FIG. 3 is a circuit diagram illustrating a pixel according to an exemplary embodiment of the present invention.

FIG. 3 is a circuit diagram illustrating a pixel according to an exemplary embodiment of the present invention.

Referring to FIG. 3, the pixel 20 includes a switching transistor TR1, a driving transistor TR2, a compensation transistor TR3, an initialization transistor TR4, a first capacitor C1, a second capacitor C2, and an organic light emitting diode OLED.

The switching transistor TR1 includes a gate electrode coupled to the scan line, one electrode coupled to a first node N1, and the other electrode coupled to a second node N2. The switching transistor TR1 is turned on by a scan signal S[i] with the gate On voltage Von applied to the scan line to electrically connect the first node N1 and the second node N2 ($1 \le i \le n$, $1 \le j \le m$).

The driving transistor TR2 includes a gate electrode coupled to a third node N3, one electrode coupled to a first power source voltage ELVDD, and the other electrode coupled to a fourth node N4. The driving transistor TR2 is turned on/off by a voltage of the third node N3 to control a driving current supplied to the organic light emitting diode (OLED).

The compensation transistor TR3 includes a gate electrode coupled to the compensation control line, one electrode coupled to the second node N3, and the other electrode coupled to the fourth node N4. The compensation transistor TR3 is turned on by the compensation control signal GC with the gate ON voltage to electrically connect the gate electrode and the other electrode of the driving transistor TR2.

The initialization transistor TR4 includes a gate electrode connected to the initialization line, one electrode coupled to the first power source voltage ELVDD, and the other electrode coupled to the second node N2. The initialization transistor TR4 is turned on by the initialization signal SUS of the gate ON voltage to transmit the first power source voltage ELVDD to the second node N2.

The first capacitor C1 includes one electrode coupled to the data line Dj and the other electrode coupled to the first node N1.

The second capacitor C2 includes one electrode coupled to the second node N2 and the other electrode coupled to the third node N3.

The organic light emitting diode (OLED) includes an anode electrode coupled to the fourth node 4 and a cathode electrode coupled to the second power source voltage ELVSS. The organic light emitting diode (OLED) may emit light of one color among the primary colors. An example of the primary colors includes the three primary colors, red, green, and blue, and a desired color may be displayed by a spatial or temporal combination of the primary colors.

The switching transistor TR1, the driving transistor TR2, the compensation transistor TR3, and the initialization transistor TR4 may be p-channel electric field effect transistors. In this case, the gate ON voltage for turning on the switching transistor TR1, the driving transistor TR2, the compensation transistor TR3, and the initialization transistor TR4 is a low level voltage, and the gate OFF voltage for turning off the switching transistor TR1, the driving transistor TR2, the compensation transistor TR3, and the initialization transistor TR4 is a high level voltage.

While, the p-channel electric field effect transistor is represented in FIG. 3, at least one of the switching transistor TR1, the driving transistor TR2, the compensation transistor TR3, and the initialization transistor TR4 may be an n-channel electric field effect transistor. In this case, the gate ON voltage for turning on the n-channel electric field effect transistor is a high level voltage, and the gate OFF voltage for turning off the n-channel electric field effect transistor is a low level voltage.

The first power source voltage ELVDD and the second power source voltage ELVSS supply the driving voltages necessary for a pixel operation.

Figure 4:
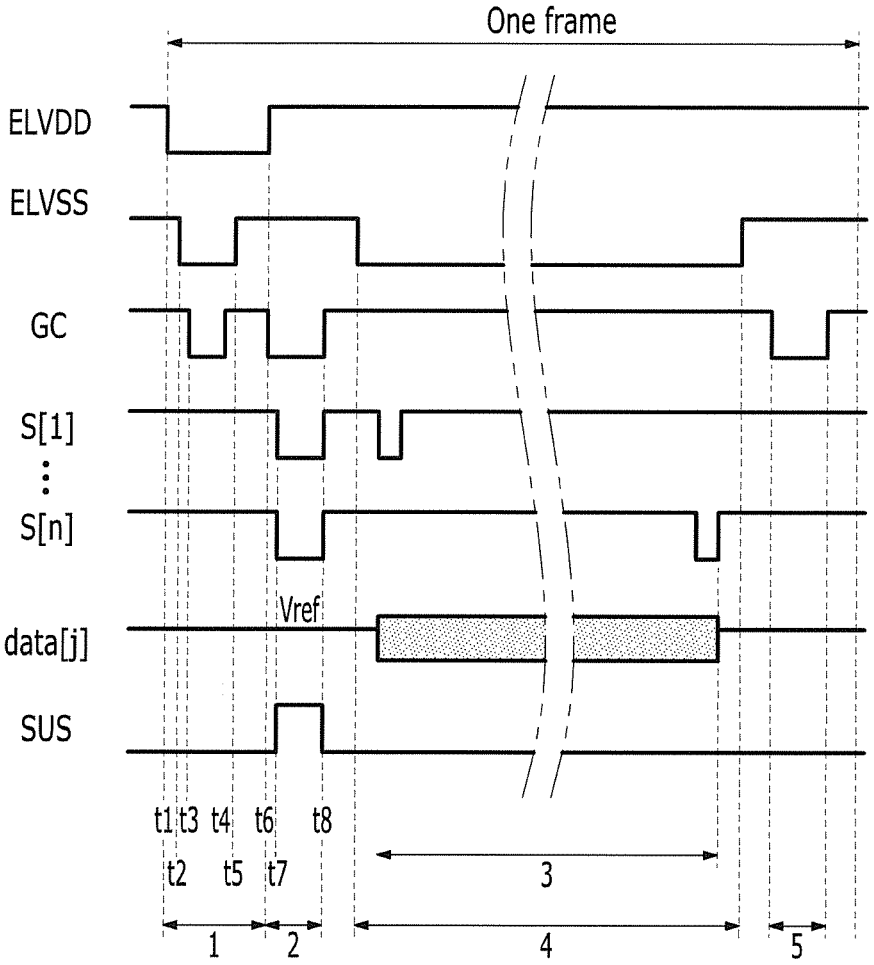
FIG. 4 is a timing diagram illustrating a method of driving a display device according to an exemplary embodiment of the present invention.

FIG. 4 is a timing diagram illustrating a method of driving the display device according to an exemplary embodiment of the present invention.

Referring to FIGS. 3 and 4, a method of driving the display device including the pixel 20 according to the exemplary embodiment of the present invention will be described.

The first power source voltage ELVDD, the second power source voltage ELVSS, the scan signals S[1]-S[n], the compensation control signal GC, the initialization signal SUS, and the data signals data[1]-data[m] are changed according to each of the initialization period 1, the compensation period 2, the scan period 3, the light emitting period 4, and the bias period 5 for one frame.

In the initialization period 1, the initialization signal SUS is applied with a low level voltage and the initialization transistor T4 is turned on.

At time t1 of the initialization period 1, the first power source voltage EVLDD is changed to the low level voltage, and the first power source voltage ELVDD of the lower level voltage is transmitted to the second node N2 through the turned-on initialization transistor TR4. A voltage of the second node N2 becomes the low level voltage, and a voltage of the third node N3 is decreased by coupling through the second capacitor C2. The voltage of the third node N3 becomes a voltage low enough to turn on the driving transistor TR2. Current flows from the fourth node N4 to the first power source voltage ELVDD through the driving transistor TR2 so that a voltage of the fourth node N4 is decreased.

At time t2 of the initialization period 1, when the second power source voltage ELVSS is changed to the low level voltage, the voltage of the fourth node N4 is further decreased by coupling by a parasitic capacitor of the organic light emitting diode (OLED).

At time t3 of the initialization period 1, the compensation control signal GC is applied with a low level voltage and the compensation transistor TR3 is turned on. The third node N3 and the fourth node N4 are coupled according to the turn-on of the compensation transistor TR3, and the voltages of the third node N3 and the fourth node N4 become voltages in a level similar to that of the low level voltage of the first power source voltage ELVDD. That is, the voltage of the third node N3 and the anode voltage of the organic light emitting diode OLED are reset to the low level voltage.

At time t4 of the initialization period 1, the compensation control signal GC is applied with a high level voltage and the compensation transistor TR3 is turned off.

At term t5 of the initialization period 1, the second power source voltage ELVSS is changed to the high level voltage. When the second power source voltage ELVSS is changed to the high level voltage, the voltage of the fourth node N4 is increased by the parasitic capacitor of the organic light emitting diode (OLED). In this case, the compensation transistor TR3 is in the turned-off state, and the voltage of the third node N3 maintains the low level voltage, so that the driving transistor TR2 is turned on by a gate-source voltage difference. Current flows from the fourth node N4 to the first power source voltage ELVDD through the turned-on driving transistor TR2, and the voltage of the fourth node N4 is decreased again.

At time t6 of the compensation period 2, the first power source voltage ELVDD is changed to the high level voltage, and the compensation control signal GC is applied with the low level voltage. The compensation transistor TR3 is turned on by the compensation control signal GC to diode-connect the driving transistor TR2. The voltage of the third node N3 becomes ELVDD+Vth. Here, ELVDD means the high level voltage of the first power source voltage ELVDD and Vth means a threshold voltage of the driving transistor TR2. In this case, the initialization signal SUS is applied with the low level voltage, and the initialization transistor TR4 is in the turned-on state. The high level voltage of the first power source voltage ELVDD is transmitted to the second node N2 through the turned-on initialization transistor TR4, and the voltage of the second node N2 becomes ELVDD.

At time t7 of the compensation period 2, the plurality of scan signals S[1]-S[n] are applied with a low level voltage, and the initialization signal SUS is applied with a high level voltage. The initialization transistor TR4 is turned off according to the application of the initialization signal SUS with the high level voltage. The switching transistor TR1 is turned on according to the application of the plurality of scan signals S[1]-S[n] with the low level voltage, and the first node N1 and the second node N2 are coupled. In this case, the data signal data[j] is applied with a reference voltage Vref. A voltage stored in the first capacitor C1 is ELVDD-data, which is a voltage stored in the first capacitor C1 at the scan period 3 of the previous frame of the current frame. This will be described later in a description of the scan period 3. Here, data means the voltages of the data signals data[1]-data[m]. The voltage of the second node N2 is changed by the voltage stored in the first capacitor C1 according to the turn-on of the switching transistor TR1 in a state where the reference voltage Vref is applied to the data line Dj. The voltage Vd of the second node N2 is applied as represented in Equation 1.

$$Vd = \mathrm{ELVDD} + (-\mathrm{data} + Vref) \times \alpha$$

$$\alpha = Cst/(Cst + Cx),$$

$$Cx = Cth \times (Cpara + Coled)/(Cth + Cpara + Coled) \quad \text{[Equation 1]}$$

Here, Vd is a voltage of the second node N2, Cst is a capacitance of the first capacitor C1, Cth is a capacitance of the second capacitor C2, Cpara is a parasitic capacitance of the driving transistor TR2, and Coled is a parasitic capacitance of the organic light emitting diode (OLED). The voltage of ELVDD-data+Vref is transmitted to the second node N2 according to the turn-on of the switching transistor TR1. However, because the parasitic capacitor of the organic light emitting diode (OLED), the parasitic capacitor of the driving transistor TR2, and the second capacitor C2 are coupled in series, and the first capacitor C1 is coupled thereto the voltage Vd of the second node is applied as represented in Equation 1. The voltage of the third node N3 is applied (e.g., continuously applied) with ELVDD+Vth, and the voltage of (ELVDD+Vth)−Vd is stored in the second capacitor C2. That is, a data voltage of the previous frame is reflected in the voltage Vd of the second node, so that the voltage in which the data voltage of the previous frame is reflected is stored in the second capacitor C2.

At time t8 of the compensation period 2, the compensation control signal GC and the plurality of scan signals S[1]-S[n] are applied with a high level voltage, and the initialization signal SUS is applied with a low level voltage. The switching transistor TR1 and the compensation transistor TR3 are turned off. The initialization transistor TR4 is turned on by the initialization signal SUS, and the first power source voltage ELVDD of the high level voltage is transmitted to the second node N2. The voltage Vg of the third node N3 is changed as represented in Equation 2 by coupling by the second capacitor C2 according to the change of the voltage of the second node N2 to ELVDD.

$$\begin{aligned} Vg &= (ELVDD + Vth) + (ELVDD - Vd) \times \beta \\ &= (1 + \beta) \times ELVDD + Vth - Vd \times \beta \\ &= (1 + \beta) \times ELVDD + Vth - \\ &\quad \{ELVDD + (-\mathrm{data} + Vref) \times \alpha\} \times \beta \\ &= ELVDD + Vth - (-\mathrm{data} + Vref) \times \alpha \times \beta \end{aligned} \quad \text{[Equation 2]}$$

$$\beta = Cth/(Cth + Cpara)$$

Here, Vg is a voltage of the third node N3, Cth is a capacitance of the second capacitor C2, and Cpara is a parasitic capacitance of the driving transistor TR2.

At the light emitting period 4, the first power source voltage ELVDD maintains a high level voltage and the second power source voltage ELVSS is changed to a low level voltage. Current flows in the organic light emitting diode OLED through the driving transistor TR2 according to the change of the second power source voltage ELVSS to the low level voltage. Driving current I_OLED flowing to the organic light emitting diode (OLED) is represented by Equation 3.

$$\begin{aligned} \mathrm{I_OLED} &= k(Vgs - Vth)^2 \\ &= k\{ELVDD + Vth - (-\mathrm{data} + Vref) \times \\ &\quad \alpha \times \beta - ELVDD - Vth\}^2 \\ &= k\{(Vref - \mathrm{data}) \times \alpha \times \beta\}^2 \end{aligned} \quad \text{[Equation 3]}$$

Here, k is a parameter determined according to a characteristic of the driving transistor TR2. The organic light emitting diode (OLED) emits light with luminance corresponding to the driving current I_OLED. That is, the organic light emitting diode (OLED) emits light with luminance corresponding to the data voltage data regardless of a deviation of the threshold voltage Vth of the driving transistor TR2 and voltage drop of the first power source voltage ELVDD. When the light emitting period 4 is terminated, the second power source voltage ELVSS is changed to a high level voltage.

During the scan period 3, the plurality of scan signals S[1]-S[n] is sequentially applied with the low level voltage to turn on the switching transistor TR1, and the plurality of data signals data[1]-data[m] is applied in response to the plurality of scan signals S[1]-S[n]. In this case, the initialization signal SUS is applied with a low level voltage, and the initialization transistor TR4 is in the turned-on state. The first power source voltage ELVDD of a high level voltage is transmitted to the second node N2. When the switching transistor TR1 is turned on, the first power source voltage ELVDD of the high level voltage is transmitted to the first node N1. Accordingly, the voltage of ELVDD-data is stored in the first capacitor C1. When the switching transistor TR1 is turned off after the voltage ELVDD-data is stored in the first capacitor C1, the first node N1 becomes a floating state, and even though the voltage of the data line Dj is changed later, the voltage Vref-data stored in the first capacitor C1 is maintained. The voltage ELVDD-data stored in the first capacitor C1 is used in the light emitting period 4 of a next frame.

During the bias period 5, the first power source voltage ELVDD and the second power source voltage ELVSS are applied with a high level voltage, and the compensation control signal GC is applied with a low level voltage. The compensation transistor TR3 is turned on by the compensation control signal GC, and the third node N3 and the fourth node N4 are coupled, so that the voltages of the third node N3 and the fourth node N4 are reset to a specific voltage. That is, the gate, source, and drain voltages of the driving transistor TR2 are applied with the specific voltage, and a response waveform of the pixel may be improved. The bias period 5 may be omitted.

As described above, since the suggested pixel 20 concurrently (or simultaneously) records (or stores) data and emits light, it is possible to obtain a sufficient (or suitable) data recording time. Accordingly, the pixel is appropriate for a large and high resolution display panel, and is capable of securing a sufficient aperture ratio due to the use of the two capacitors.

Further, the suggested pixel 20 may be driven based on the data lines and the first power source voltage ELVDD when the data is recorded, and may be driven based on the data line in which equivalent resistance is designed when the threshold voltage is compensated for. Accordingly, the suggested pixel 20 may not require an additional reference voltage line for the reference voltage Vref, there is not a problem of the screen not being uniformly displayed due to influence of the reference voltage line, and the screen may be stably and uniformly displayed.

Figure 5:
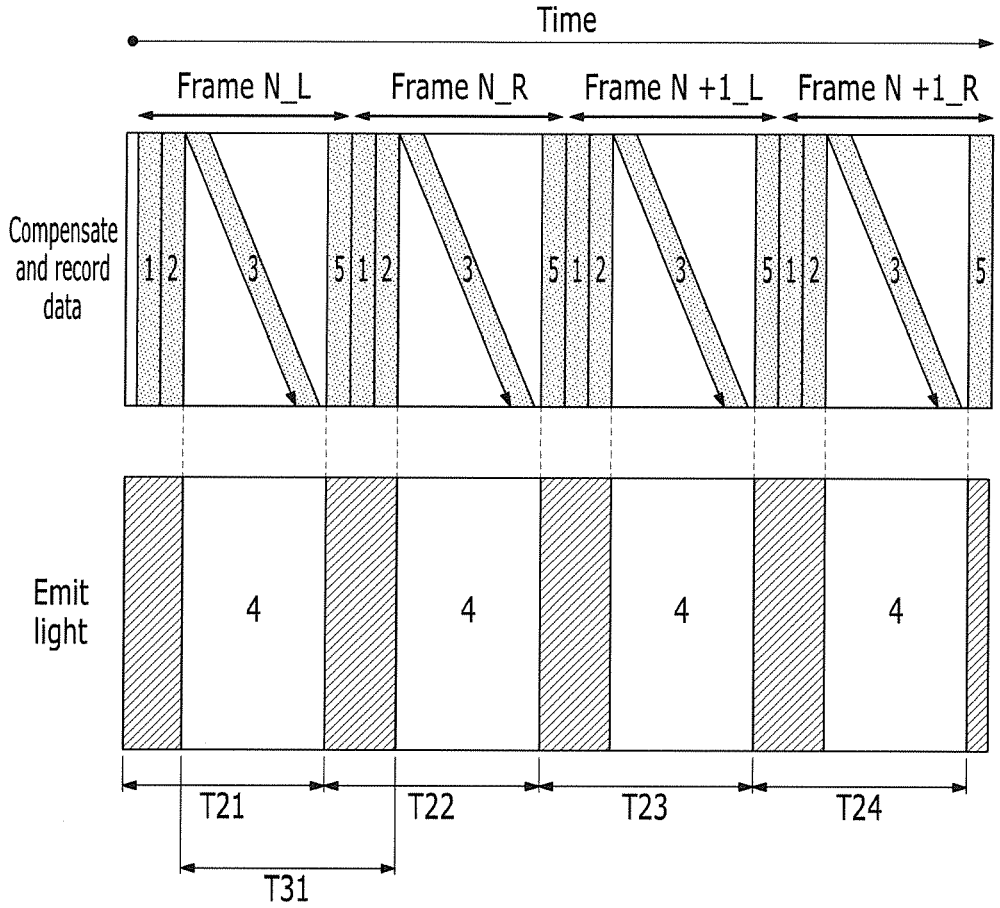
FIG. 5 is a diagram illustrating a method of driving a display device according to another exemplary embodiment of the present invention.

FIG. 5 is a diagram illustrating a method of driving a display device according to another exemplary embodiment of the present invention.

Referring to FIG. 5, the display device 10 employs a driving method of alternately displaying a left-eye image and a right-eye image according to a shutter spectacles method. As illustrated in FIG. 5, each frame includes the initialization period 1, the compensation period 2, the scan period 3, the light emitting period 4, and the bias period 5.

Frames in which the plurality of data signals representing the left-eye image (hereinafter, referred to as "left-eye image data signals") is denoted by reference numeral "L", and frames in which the plurality of data signals representing the right-eye image (hereinafter, referred to as "right-eye image data signals") is denoted by reference numeral "R".

The waveforms of the first power source voltage ELVDD, the second power source voltage ELVSS, the compensation control signal GC, the scan signals S[1]-S[n], the data signals data[1]-data[m], and the initialization signal SUS in each of the initialization period 1, the compensation period 2, the scan period 3, the light emitting period 4, and the bias period 5 are the same as the waveform illustrated in FIG. 4, so a detailed description for each term will be given by way of reference to the above description.

The left-eye image data signals of the frame N_L are recorded in the plurality of pixels during the scan period 3 of term T21. The plurality of pixels emit light according to the right-eye image data signals recorded during the scan period 3 of the frame N−1_R during the light emitting period 4 of the term T21.

The right-eye image data signals of the frame N_R are recorded in the plurality of pixels during the scan period 3 of term T22. The plurality of pixels emit light according to the left-eye image data signals recorded during the scan period 3 of the frame N_L during the light emitting period 4 of the term T22.

The left-eye image data signals of the frame N+1_L are recorded in the plurality of pixels during the scan period 3 of term T23. The plurality of pixels emit light according to the right-eye image data signals recorded during the scan period 3 of the frame N_R during the light emitting period 4 of the term T23.

The right-eye image data signals of the frame N+1_R are recorded in the plurality of pixels during the scan period 3 of term T24. The plurality of pixels emit light according to the left-eye image data signals recorded during the scan period 3 of the frame N+1_L during the light emitting period 4 of the term T24.

The right-eye image concurrently (or simultaneously) is emitted during the recording of the left-eye image by the aforementioned method, and the left-eye image concurrently (or simultaneously) is emitted during the recording of the right-eye image. Accordingly, a light emitting time may be sufficiently obtained, thereby improving a quality of a three-dimensional image.

The scan period 3 and the light emitting period 4 are part of the same term so that an interval T31 between the light emitting periods 4 of the respective frames may be set regardless of the scan period. In this case, the interval T31 between the light emitting periods 4 may be set at an interval optimized to a liquid crystal response speed of shutter spectacles.

By way of comparison, in a case where the scan period 3 and the light emitting period 4 are not part of the same term, the light emitting period 4 may be positioned after the scan period 3 so that a temporal margin at which the light emitting period 4 may be set among the terms of one frame is small.

In the suggested driving method, the light emitting period 4 may be set at a time other than the initialization period, the compensation period, and the bias period among the terms of one frame. Accordingly, the temporal margin at which the light emitting period 4 may be set is increased (compared to the above example) so that it is possible to set the interval T31 between the light emitting periods 4 considering the liquid crystal response speed of the shutter spectacles.

For example, it is possible to set the interval T31 between the light emitting periods 4 considering a time taken for completely opening a right-eye lens (or a left-eye lens) of the shutter spectacles from a termination time of the light emission of the left-eye image (or the right-eye image).

The foregoing referenced drawings and detailed description of the present invention are all exemplary and used for explaining the present invention, and do not limit the meaning or the scope of the present invention defined in the claims. Accordingly, those skilled in the art will appreciate that various modifications and equivalent another embodiment may be possible. Accordingly, the true technical protection scope of the present invention will be defined by the technical spirit of the accompanying claims and equivalents thereof.

What is claimed is:

1. A display device comprising a plurality of pixels, each of the plurality of pixels comprising:

a first capacitor coupled between a data line and a first node;

a switching transistor configured to electrically connect the first node and a second node;

a second capacitor coupled between the second node and a third node;

an initialization transistor for transmitting a first power source voltage to the second node; and a driving transistor comprising a gate electrode coupled to the third node and configured to control a driving current flowing from the first power source voltage to an organic light emitting diode, wherein:

light emission of the organic light emitting diode by the driving current is configured to be concurrently performed in the plurality of pixels, an initialization signal having a gate ON voltage is configured to be transmitted so that the initialization transistor is turned on, and a scan signal having the gate ON voltage and corresponding to each of the plurality of pixels is configured to be transmitted to the switching transistor so that a data voltage corresponding to the first capacitor is stored, wherein the first capacitor is configured to store a data voltage during the light emission of the organic light emitting diode in a light-emitting period of a current frame, the stored data voltage to be utilized for the light-emitting period of a next frame.

2. The display device of claim 1, wherein:

each of the plurality of pixels further comprises a compensation transistor for electrically connecting the gate electrode and an other electrode of the driving transistor together.

3. The display device of claim 2, wherein:

the initialization transistor is configured to be turned on and the first power source voltage is configured to be changed to a low level voltage so that a voltage of the third node is decreased through coupling by the second capacitor, and so that current flows from an anode electrode of the organic light emitting diode to the first power source voltage through the driving transistor to decrease an anode voltage of the organic light emitting diode.

4. The display device of claim 3, wherein:

after the anode voltage of the organic light emitting diode is decreased, a second power source voltage applied to a cathode electrode of the organic light emitting diode is configured to be changed to the low level voltage so that the anode voltage of the organic light emitting diode is further decreased through coupling by a parasitic capacitor of the organic light emitting diode.

5. The display device of claim 4, wherein:

after the second power source voltage is changed to the low level voltage, a compensation control signal having the gate ON voltage is configured to be applied to the compensation transistor so that the compensation transistor is turned on and the anode voltage of the organic light emitting diode is reset.

6. The display device of claim 5, wherein:

after the anode voltage of the organic light emitting diode is reset, the second power source voltage is configured to be changed to a high level voltage.

7. The display device of claim 6, wherein:

after the second power source voltage is changed to the high level voltage, the first power source voltage is configured to be changed to the high level voltage in a state where the initialization transistor is turned on and the compensation transistor is turned on to diode-connect the driving transistor.

8. The display device of claim 7, wherein:

after the driving transistor is diode-connected, the initialization transistor is configured to be turned off, the switching transistor is configured to be turned on, and a reference voltage is configured to be applied to the data line so that a voltage of the second node is changed by the data voltage stored in the first capacitor, and so that a voltage corresponding to the data voltage is stored in the second capacitor.

9. The display device of claim 8, wherein:

the data voltage stored in the first capacitor in a current frame is configured to be a data voltage applied in a previous frame, and a voltage corresponding to the data voltage applied in the previous frame is configured to be stored in the second capacitor.

10. The display device of claim 8, wherein:

after the voltage corresponding to the data voltage is stored in the second capacitor, the switching transistor and the compensation transistor are configured to be turned off and the initialization transistor is configured to be turned on so that the voltage of the third node is changed.

11. The display device of claim 10, wherein:

after the voltage of the third node is changed, the first power source voltage is configured to be maintained at the high level voltage, and the second power source voltage is configured to be changed to the low level voltage so that the organic light emitting diode emits light according to the driving current flowing to the organic light emitting diode through the driving transistor.

12. The display device of claim 11, wherein:

after the organic light emitting diode emits light, the second power source voltage is configured to be changed to the high level voltage, and the compensation transistor is configured to be turned on so that the voltage of the gate electrode and the other electrode of the driving transistor are reset to a specific voltage.

13. A method of driving a display device comprising a plurality of pixels, each of the plurality of pixels comprising: a first capacitor coupled between a data line and a first node, a switching transistor configured to electrically connect the first node and a second node, a second capacitor coupled between the second node and a third node, an initialization transistor for transmitting a first power source voltage to the second node, and a driving transistor comprising a gate electrode coupled to the third node to control a driving current to flow from the first power source voltage to an organic light emitting diode, the method comprising:

a scanning operation in which an initialization signal having a gate ON voltage is applied to a gate electrode of the initialization transistor and a scan signal having the gate ON voltage is applied to the gate electrode of the switching transistor so that a data voltage of a current frame period is stored in the first capacitor, wherein the current frame period is also utilized for light emission;

a light emitting operation in which the organic light emitting diode emits light according to the driving current flowing through the driving transistor according to a voltage of a previous frame stored in the second capacitor; and an initialization operation in which the first power source voltage and a second power source voltage transmitted to a cathode electrode of the organic light emitting diode are at a low level voltage, and a compensation transistor for electrically connecting the gate electrode and an other electrode of the driving transistor together is turned on so that an anode voltage of the organic light emitting diode is reset, wherein the light emitting operation of each of the plurality of pixels is concurrently performed, and wherein the scanning operation and the light emitting operation for each of the plurality of pixels at least partially overlap each other.

14. The method of claim 13, wherein: the initialization operation comprises:

turning on the initialization transistor and changing the first power source voltage to the low level voltage to decrease a voltage of the third node through coupling by the second capacitor; and making current flow to the first power source voltage from an anode electrode of the organic light emitting diode through the driving transistor to decrease the anode voltage of the organic light emitting diode.

15. The method of claim 14, wherein the initialization operation further comprises:

changing the second power source voltage applied to the cathode electrode of the organic light emitting diode to the low level voltage after the anode voltage of the organic light emitting diode is decreased to further decrease the anode voltage of the organic light emitting diode through coupling by a parasitic capacitor of the organic light emitting diode.

16. The method of claim 15, wherein the initialization operation further comprises:

changing the second power source voltage to a high level voltage after the anode voltage of the organic light emitting diode is reset.

17. The method of claim 16, further comprising:

a compensation operation in which, after the second power source voltage is changed to the high level voltage, the first power source voltage is changed to the high level voltage in a state where the initialization transistor is turned on and the compensation transistor is turned on to diode-connect the driving transistor.

18. The method of claim 17, wherein the compensation operation comprises:

turning off the initialization transistor after the driving transistor is diode-connected;

applying a reference voltage to the data line and turning on the switching transistor; and changing the voltage of the second node according to a data voltage stored in the first capacitor, and storing a voltage corresponding to the data voltage in the second capacitor.

19. The method of claim 18, wherein:

the data voltage stored in the first capacitor in a current frame is a data voltage applied in a previous frame, and the storing of the voltage corresponding to the data voltage in the second capacitor comprises storing a voltage corresponding to the data voltage applied in the previous frame in the second capacitor.

20. The method of claim 18, wherein the compensation operation further comprises:

turning off the switching transistor and the compensation transistor after the voltage corresponding to the data voltage is stored in the second capacitor; and turning on the initialization transistor to change the voltage of the third node.

21. The method of claim 20, wherein the light emitting operation comprises:

maintaining the first power source voltage at the high level voltage and changing the second power source voltage to the low level voltage after the voltage of the third node is changed; and making the organic light emitting diode emit light by making the driving current flow to the organic light emitting diode through the driving transistor.

22. The method of claim 21, further comprising:

a bias operation in which the second power source voltage is changed to the high level voltage after the organic light emitting diode emits light, and the compensation transistor is turned on so that the voltage of the gate electrode and the other electrode of the driving transistor are reset to a specific voltage.

23. A pixel, comprising:

a first capacitor comprising one electrode coupled to a data line and an other electrode coupled to a first node;

a switching transistor comprising a gate electrode for receiving a scan signal, one electrode coupled to the first node, and an other electrode coupled to a second node;

a second capacitor comprising one electrode coupled to the second node and an other electrode coupled to a third node;

a driving transistor comprising a gate electrode coupled to the third node, one electrode coupled to a first power source for supplying a first power source voltage, and an other electrode coupled to an anode electrode of an organic light emitting diode; and an initialization transistor comprising a gate electrode for receiving an initialization signal, one electrode coupled to the first power source voltage, and an other electrode coupled to the second node, wherein the first capacitor is configured to store a data voltage during light emission of the organic light emitting diode in a light-emitting period of a current frame, the stored data voltage to be utilized for the light-emitting period of a next frame.

24. The pixel of claim 23, further comprising:

a compensation transistor comprising a gate electrode for receiving a compensation control signal, one electrode coupled to the third node, and an other electrode coupled to the anode electrode of the organic light emitting diode.

* * * * *